US005921178A

United States Patent [19]

Binnen

[11] Patent Number: 5,921,178

[45] Date of Patent: Jul. 13, 1999

[54] WIPE BLADE DEVICE FOR TAMPON PRINTING MACHINES

[76] Inventor: Ewald Binnen, Robert-Bosch-Str.114/1, D-74081 Heilbronn, Germany

[21] Appl. No.: 09/022,539

[22] Filed: Feb. 12, 1998

[30] Foreign Application Priority Data

Feb. 27, 1997 [DE] Germany ..... 297 03 500 U

[51] Int. Cl.[6] ..... B41F 17/00

[52] U.S. Cl. ..... 101/169; 101/41

[58] Field of Search ..... 101/35, 41, 42, 101/43, 44, 150, 163, 167, 169, 170

[56] References Cited

U.S. PATENT DOCUMENTS 3,916,784 11/1975 Dubuit ..... 101/41

5,383,398 1/1995 Binnen ..... 101/41

*Primary Examiner*—Edgar Burr
*Assistant Examiner*—Amanda B. Sandusky
*Attorney, Agent, or Firm*—Paul Vincent

[57] ABSTRACT

In order to create a wipe blade device for tampon printing machines, having a wipe blade 39 which moves back and forth relative to a printing block 41, which is distinguished by its simple construction and low number of easily produced individual components as well as its compact configuration of the guiding elements, a double scissors 13 is provided for which is pivotably borne on one side on the wipe blade mount 12 and on its other side in an approximately stationary fashion with respect to the printing block 41. The intermediately disposed free ends of the double scissors 13, 16, 21 are pivotably connected to each other, the arms of which 15, 20 are in mutually toothed engagement 19, 24 at least at one side.

9 Claims, 3 Drawing Sheets

WIPE BLADE DEVICE FOR TAMPON PRINTING MACHINES

This application claims Paris Convention priority of German utility application No. 297 03 500.2 filed Feb. 27, 1997, the complete disclosure of which is hereby incorporated by reference.

BACKGROUND OF THE INVENTION

In conventional wipe blade devices for tampon printing machines, the wipe blade initially seats on the printing block and is moved horizontally across the printing block to wipe the ink from the printing block into the ink tub. Since, when moving the wipe blade back into its original position, the wipe blade is not allowed to contact the printing block, it must be lifted so that the wipe blade mount must be moved both in the horizontal as well as in the vertical direction. Conventional systems effect this motion using difficult and expensive rod assemblies and linear guides.

SUMMARY OF THE INVENTION

The purpose of the present invention is to create a wipe blade device of the above mentioned kind which is characterized by its simple construction and small number of easily produced individual components and which does not require a large amount of space for the guiding elements. This is achieved in accordance with the invention by a double scissors pivotably borne at one side on the wipe blade mount and which, on the other side, is approximately stationary with respect to the printing block. The intermediately disposed free ends of the double scissors are pivotably connected to each other and its arms are in mutual toothed engagement at least at one side. In this manner, a reliable and constant parallel displacement of the wipe blade relative to the printing block is achieved. The arms in mutual toothed engagement guarantee an even motion of the scissor arms and also serve to support the wipe blade in a vertical direction. In order to improve the even parallel motion during horizontal displacement and to eliminate as much play as possible, the free ends of both scissor components are preferentially in toothed mutual engagement. Towards this end the scissors arms have gears. The scissors is driven by a push lever controlled by a cam guide which moves relatively thereto. An advantageous point of engagement for this lever is the wipe blade mount, wherein a pin of the mount engages a slotted hole of the lever.

In order to also be able to effect the horizontal motion in a simple manner, an angled lifting lever is provided for which can be tilted about an axis approximately parallel to the plane of the printing block, one arm of which supports the approximately stationary portion of the double scissors and the other arm of which is supported on a cam guide which moves relative thereto to control the tilting motion. The two cam guides for controlling the horizontal and vertical motion of the wipe blade are adjusted to each other in such a fashion that the wipe blade remains seated on the printing block during the wiping procedure and during the backward motion, is lifted from the printing block by the pivoting of the lifting lever.

When the wipe blade device in accordance with the invention is utilized in tampon printing machines having a plurality of printing stations disposed on a rotating plate or the like, a closed cam guide is provided for which is stationary relative to the plate for engagement of the push lever, wherein the push lever is an angular lever engaging, with a guide member on a lever arm, into the groove-like cam guide.

A cam guide which is stationary with respect to the plate is also provided for the stroke lever, wherein the free arm of the stroke lever is supported by this cam guide via a guide member.

The drawing shows an embodiment of the invention.

DESCRIPTION OF THE PREFERRED EMBODIMENT

Figure 1:
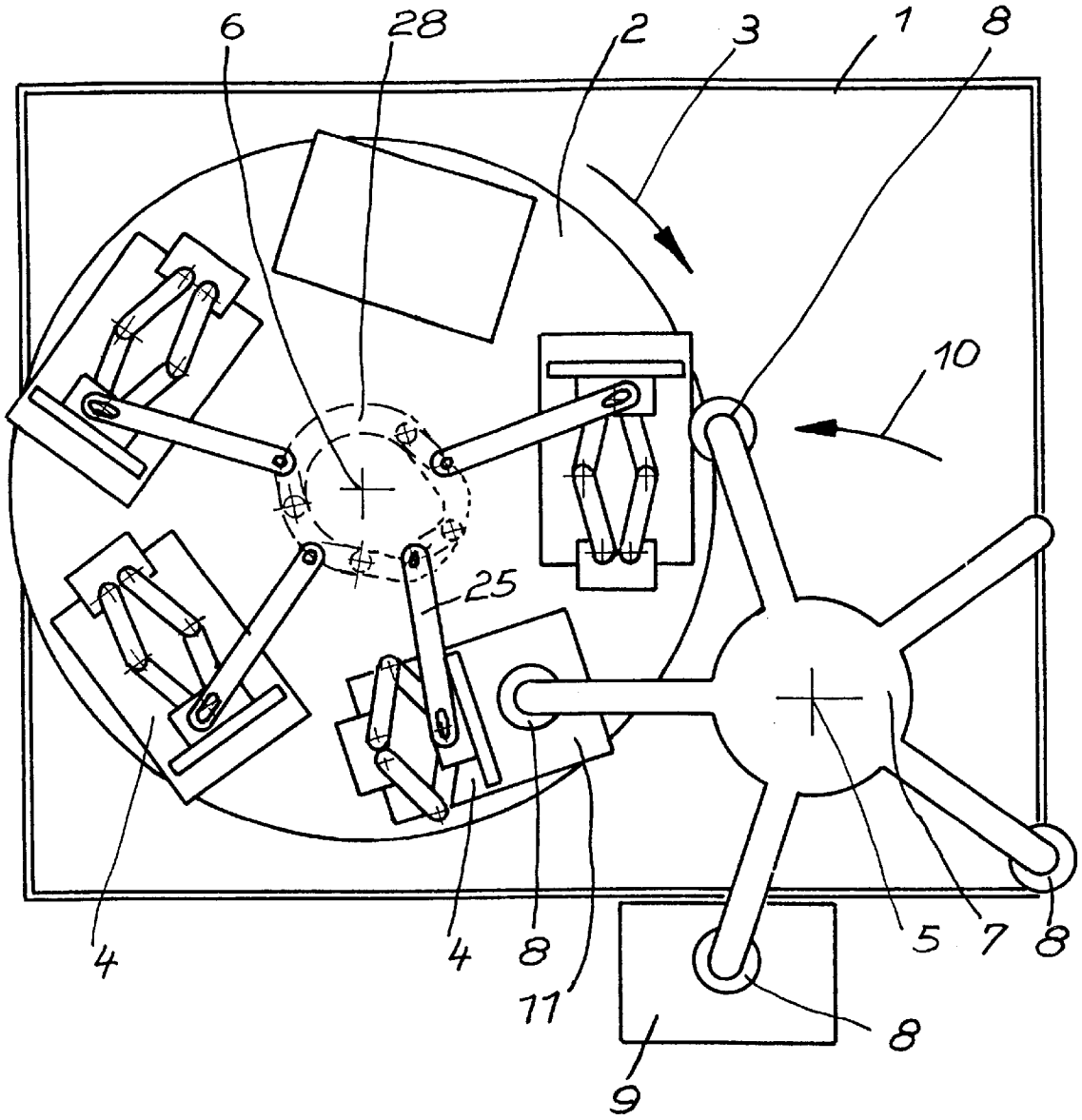
FIG. 1 shows a schematic plan view of a tampon printing machine having a plurality of printing stations disposed on a rotating plate.

A plate 2 is disposed for rotation in the direction of arrow 3 on the machine frame 1 of a tampon printing machine. Four printing stations 4 are provided on this plate to facilitate four-colour-printing. In addition, a tampon mount 7 is provided for on an axis 5 parallel to the plate axis 6 which is also likewise provided with four tampons 8. The plate 2 and the tampon mount 7 rotate synchronously in accordance with arrows 3 and 10 in opposite directions, wherein the tampon mount 7 exercises out an additional vertical motion in the stationary phase. During downward motion, each tampon 8 removes ink from the printing block 11 coated with a particular colour and then prints an arbitrary object on table 9. During continued rotation, the next tampon 8 is then inked by the subsequent printing station and, for its part, prints the same object with the next colour until all four printing stations have been processed.

Figure 2:
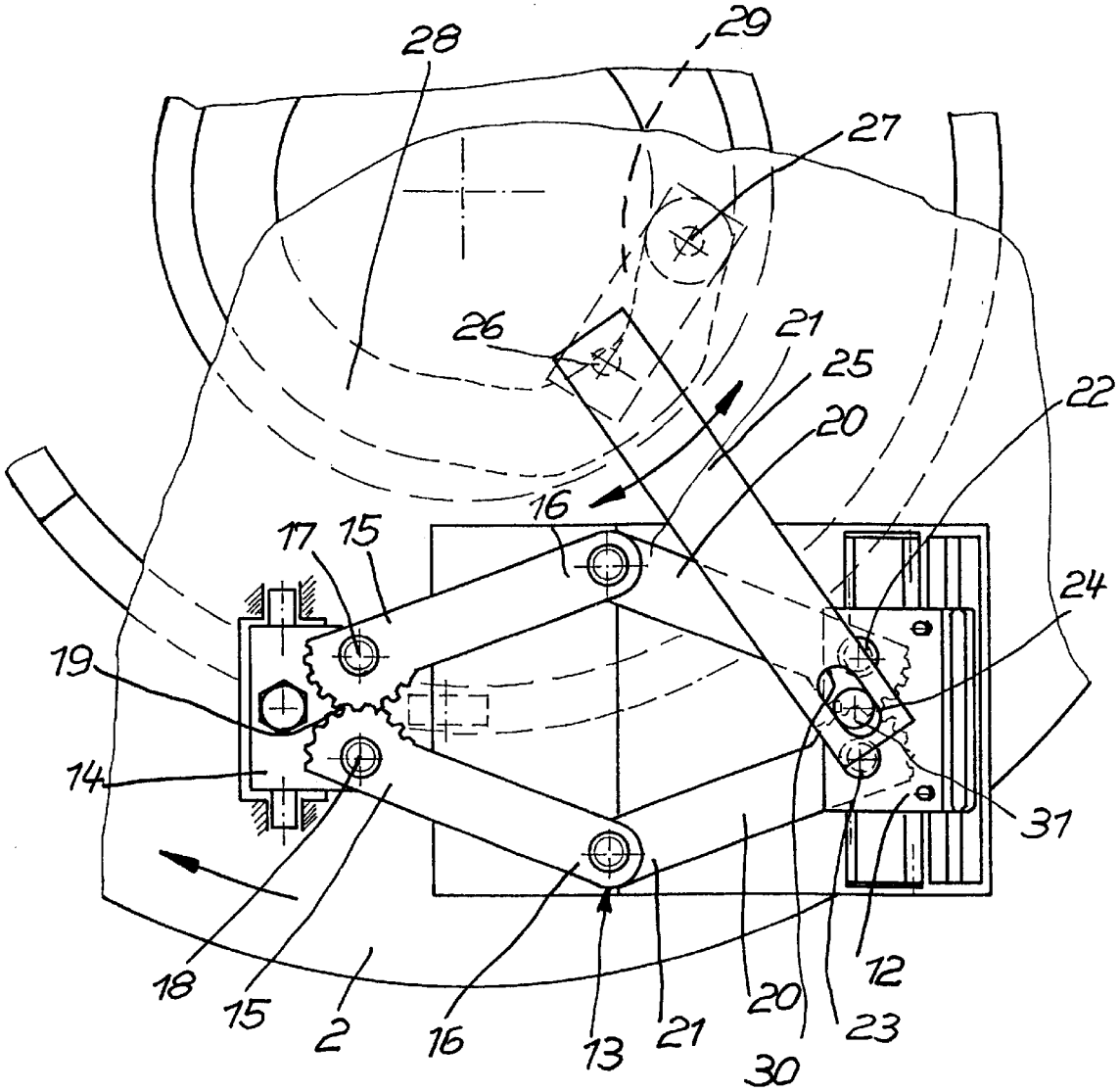
FIG. 2 shows an enlarged broken-off and partial cut section of FIG. 1.
Figure 3:
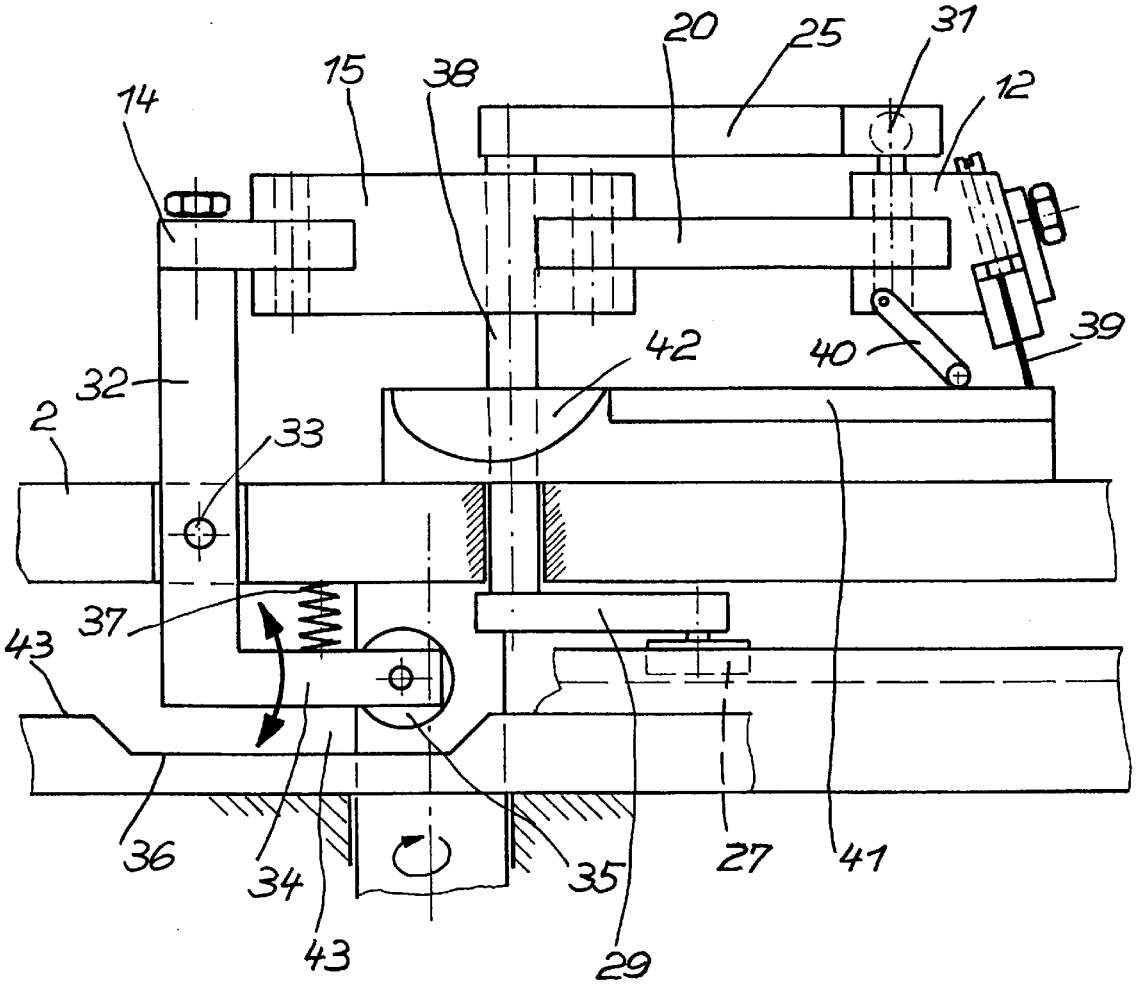
FIG. 3 shows a cross-section in accordance with FIG. 2.

The wipe plate device is represented in detail in FIGS. 2 and 3. The wipe blade mount 12 is connected, via a double scissors 13, to a mount 14 which is nearly stationary on plate 2. Arms 15 are thereby borne in a pivotable fashion on the mount at 17 and 18 and engage, by means of their gearing 19, into each other. The other arms 20 are, for their part, pivotably borne on wipe blade mount 12 at 22 and 23 and are in toothed mutual engagement via gearing 24. The free ends 16 and 21 of of the arms 15 and 20 are thereby pivotably connected to each other.

The horizontal motion of the wipe blade mount 12 is controlled by a push lever 25. The push lever 25 is rigidly attached to the arm or cam lever 29 via axle 38 pivotably borne in the plate 2. A guide member 27 is disposed on the free end of the arm 29 and engages into a cam guide 28 which is stationary with respect to the plate 2. The push lever 25 is provided with a slotted hole 30 at its free end into which a guide pin 31, disposed on wipe blade mount 12, engages.

The vertical motion of the wipe blade mount 12 is effected via a lifting lever 32 which supports the mount 14 and thereby, via the double scissors 13, the wipe blade mount 12. The lifting lever 32 is as an angular lever pivotably borne on plate 2 at position 33. It has a roller 35 on its lever arm 34 which cooperates with a stationary cam guide 36. The wipe blade mount 12 is pivoted in the direction towards plate 2 and the roller 35 pushed onto the cam guide 36 by means of a compression spring 37 disposed between the lower side of the plate 2 and the lever arm 34. The two cam guides 28 and 36 are stationary and below the rotating plate 2 and the connection between the push lever 25 and its lever arm 29 is effected by means of an axle 38 passing through the plate 2. The wipe blade 39 and the pivotable ink spatula 40 are located on the wipe blade mount 12.

During rotation of the plate 2, the wipe blade mount 12, having the wipe blade 39 seating on the printing block 41 and the ink spatula 40 are initially pulled back in dependance on the cam guide 28 out of the position shown in FIGS. 2 and 3 until the wipe blade 39 has wiped the ink from printing block 41 into the ink tub 42. The wipe blade 39 is thereby pressed onto the printing block 41 by spring 37. The guide roller 35 is thereby located above the depression of the cam guide 36 and is consequently freed. In the end position, the ink spatula 40 removes fresh ink out of the ink tub 42. Control of the horizontal motion of the wipe blade mount 12 is thereby effected by the push lever 25 which is controlled by the cam guide 28. During further rotation of the plate 2 in a clockwise direction, the guide roller 35 of the lift lever 32 thereby travels on the elevation 43 of the cam guide 36 so that the lift lever 34 moves, in opposition to the force of the spring 37, towards the plate 2 and the mount 14 and the wipe blade mount 12 are thereby pivoted in an upward direction. The return motion of the wipe blade mount 12 into its original position is effected by the cam guide 28 and the push lever 25, wherein the ink spatula 40 spreads ink onto the printing block 41.

I claim:

1. A wipe blade device for a tampon printing machine having a wipe blade which moves back and forth relative to a printing block mounted to a plate, the device comprising:

a first scissors member having a first leg and a second leg, said first and said second leg in mutual hinged cooperation at a first end of said first scissors member, said first end of said first scissors member substantially stationary relative to the printing block;

a second scissors member having a third leg and a fourth leg, said third and said fourth leg in mutual hinged cooperation at a first end of said second scissors member, said first end of said second scissors member pivotably borne on a wipe blade mount, wherein, at a second end of said first scissors member and at a second end of said second scissors member, said first leg is pivotably connected to said third leg and said second leg is pivotably connected to said fourth leg.

2. The device of claim 1, wherein said first and said second legs are in mutual toothed engagement at said first end of said first scissors member.

3. The device of claim 2, wherein said third and said fourth legs are in mutual toothed engagement at said first end of said second scissors member.

4. The device of claim 1, further comprising a cam guide controlled push lever for driving said first and said second scissors members.

5. The device of claim 4, wherein said push lever engages said wipe blade mount.

6. The device of claim 5, wherein said push lever has a slotted hole, and further comprising a pin mounted to said wipe blade mount and engaging into said slotted hole.

7. The device of claim 1, further comprising a first cam guide mounted stationary relative to the plate and an angular lift lever which can be tilted about an axis substantially parallel to a plane of the printing block, wherein a first arm of said angular lift lever is mounted to support said first end of said first scissors member and a second arm of said angular lift member cooperates with said first cam guide to control a tilting motion of said angular lift lever.

8. The device of claim 4, further comprising a second closed cam guide disposed stationary relative to the plate for engagement of said push lever, wherein said push lever comprises an axle cooperating with a cam lever having a guide member engaging into said closed cam guide.

9. The device of claim 7, wherein said second lift lever arm comprises a guide member cooperating with said first cam guide.

* * * * *